US006715190B2

(12) United States Patent
Groemminger et al.

(10) Patent No.: US 6,715,190 B2
(45) Date of Patent: Apr. 6, 2004

(54) MEMORIALIZATION CASKET

(75) Inventors: Brian K. Groemminger, Batesville, IN (US); Walter A. Hullemeyer, Batesville, IN (US); Charles F. Winburn, Batesville, IN (US)

(73) Assignee: Batesville Services, Inc., Batesville, IN (US)

( * ) Notice: Subject to any disclaimer, the term of this patent is extended or adjusted under 35 U.S.C. 154(b) by 0 days.

(21) Appl. No.: 09/788,769

(22) Filed: Feb. 20, 2001

(65) Prior Publication Data

US 2002/0112329 A1 Aug. 22, 2002

(51) Int. Cl.[7] ..... A61G 17/00
(52) U.S. Cl. ..... 27/19; 27/14
(58) Field of Search ..... 27/19, 14; D99/8, D99/10, 12; 220/376, 521, 522

(56) References Cited

U.S. PATENT DOCUMENTS

| | | | | | |
|---|---|---|---|---|---|
| 586,071 | A | * | 7/1897 | Loomis | 27/16 |
| 1,192,169 | A | * | 7/1916 | DeCamp | 27/14 |
| 1,931,828 | A | * | 10/1933 | Overstreet | 27/19 |
| 4,222,189 | A | * | 9/1980 | Kamei | 40/800 |
| 4,324,026 | A | | 4/1982 | Craft | |
| 4,357,741 | A | * | 11/1982 | Winburn et al. | 27/19 |
| 4,457,054 | A | | 7/1984 | Craft et al. | |
| 5,495,648 | A | * | 3/1996 | Rojdev et al. | 27/19 |
| 5,611,124 | A | | 3/1997 | Biondo et al. | |
| 5,675,876 | A | | 10/1997 | Benedict et al. | |
| 5,678,289 | A | | 10/1997 | Saaf | |
| 5,727,291 | A | | 3/1998 | Biondo et al. | |
| D418,961 | S | | 1/2000 | Biondo et al. | |
| 6,237,202 | B1 | * | 5/2001 | Agee et al. | 27/14 |
| 6,324,736 | B1 | * | 12/2001 | Atrio | 27/2 |

* cited by examiner

*Primary Examiner*—William L. Miller
(74) *Attorney, Agent, or Firm*—Wood, Herron & Evans, L.L.P.

(57) ABSTRACT

A memorialization casket of the type which allows it to be personalized to the deceased comprises a shell, a lid closable upon the shell and an alcove structure mounted to an under side of the lid, the alcove structure including a recessed area adapted to receive an ornament for display. The casket lid may include a dish mounted to the under side of the casket lid, with the alcove structure being mounted to the dish. The dish may have a panel which may include an opening therethrough, with the alcove structure mounted in the opening of the dish panel. An alcove structure mounting adaptor may be mounted in the dish panel opening, with the alcove structure being mounted to the adaptor. The mounting adaptor may include a fastener fastening the alcove structure to the mounting adaptor. The alcove structure may include a fastener adapted to removably retain the ornament in the alcove structure.

43 Claims, 3 Drawing Sheets

MEMORIALIZATION CASKET

FIELD OF THE INVENTION

This invention relates generally to the death care industry, and more particularly to personalized caskets for memorializing a deceased.

BACKGROUND OF THE INVENTION

Upon the death of a family member the surviving loved one of the deceased must make a number of decisions, including what type of funeral or other memorial service to hold, preparation of the body, selection of a suitable casket or cremation urn, etc. In the death care industry it is conventional for those decisions to be made in a so-called "arrangement conference." In an arrangement conference, the funeral director meets with the surviving loved one of the deceased, typically in the funeral home of the funeral director, and describes to and discusses with the surviving loved one the various funeral products and services which are available. The funeral director may use visual aids such as a product catalog, product display board (such as that disclosed in the assignee's U.S. Pat. No. 5,787,626 titled Funeral Product Display Case hereby incorporated by reference herein) and a casket selection room (such as that disclosed in the assignee's U.S. Pat. No. 5,405,017 titled Modular Casket Display System and in the assignee's pending application Ser. No. 09/638,576 titled Display For A Casket Selection and/or Viewing Room both hereby incorporated by reference herein) to illustrate the products available to the customer.

There is a trend in the death care industry to make efforts towards "personalizing" the funeral products and the funeral or other memorial service purchased for the deceased to provide a more meaningful memorial experience for the family and friends of the deceased. One of the earlier attempts at providing a means of personalizing or customizing a casket to the deceased may be seen with reference to the assignee's U.S. Pat. No. 4,457,054 titled Casket Shelf, hereby incorporated by reference herein. That patent discloses a casket shelf which is mounted to the dish assembly of the head end cap when the head end cap is in the open position. The shelf provides a surface for supporting and displaying articles of religious or personal significance to the deceased.

Many casket manufacturers and funeral directors now manufacture and offer many "custom modular" variations of caskets, rather than selling mere "cookie cutter" or "one size fits all" caskets, thereby allowing the loved one to in essence design a specific casket especially suited or tailored to the deceased. For example, customers can select from a number of casket materials, casket finishes, casket corner adornments and casket interiors. Advances made in the area of "quick change" and "tool less" fastening mechanisms have greatly facilitated the rapid removal of one accessory from the casket and the rapid installation of another more desirable accessory to the casket. In addition to promoting personalization of the casket to the deceased, such interchangeability greatly reduces the amount of inventory the funeral director must keep on hand. An example may be seen in the assignee's pending application Ser. No. 09/660,574 titled Quick Change Casket Corner Attachment Mechanism and hereby incorporated by reference herein, commercially available as the LifeSymbols® line of interchangeable corner adornments available from Batesville®.

The "custom" casket interiors available to the funeral customer today include not only the internal lining material of the casket (which itself may also be of the quick-change type, see the Assignee's U.S. Pat. No. 5,784,768 titled Casket Having Quickly Interchangeable And Adjustable Interior and hereby incorporated by reference herein) but also the decorative cap panels that fit within the underneath of the casket cap which serve to present a visually aesthetically pleasing appearance to the underside of the cap when in the open position. The cap panel can be embroidered with a favorite saying of the deceased a scene depicting the deceased's hobby, etc. Special cap panels have even been designed which, in addition to performing a memorial function While installed in the casket, are adapted to be presented to the loved one surviving the deceased to be displayed by the loved one in his or her home as a keepsake. See application Ser. No. 09/165,990 titled Dish Assembly For A Burial Casket Cap assigned to the assignee of the present invention and hereby incorporated by reference herein, the subject of which is commercially available as the MemoryFrame™ line of cap panels available from Batesville®. The casket can also include a memorabilia drawer in which keepsakes of the deceased can be stored and displayed, as disclosed in the assignee's U.S. Pat. No. 5,611,124 titled Casket Having Memorabilia Compartment and hereby incorporated by reference herein, commercially available as the MemorySafe® line of caskets including memorabilia drawers available from Batesville®.

Advances have therefore been made in the area of "personalization" of funeral products as demonstrated with the novel products discussed above. However, there continues to be room for improvement in the area of personalization in the death care industry.

SUMMARY OF THE INVENTION

The present invention is a memorialization casket of the type which allows it to be personalized to the deceased. The casket comprises a shell, a lid closable upon the shell and an alcove structure mounted to an under side of the lid, the alcove structure including a recessed area adapted to receive an ornament for display.

The casket lid may include a dish mounted to the under side of the casket lid, with the alcove structure being mounted to the dish. The dish may comprise a rectangular panel having a puffing member secured to each side of the rectangular panel. The panel of the dish may include an opening therethrough, with the alcove structure mounted in the opening of the dish panel. The alcove structure may comprise a floor, a pair of side walls, a back wall and a roof. The alcove structure roof may be attractively arcuately shaped. The alcove structure may include a decorative flange extending from the floor, side walls and roof, which faces a portion of the dish panel around the dish panel opening.

The casket of this invention may further comprise an alcove structure mounting adaptor mounted in the dish panel opening, with the alcove structure being mounted to the adaptor. The alcove structure mounting adaptor may comprise a back wall and a flange, the flange being secured to the dish panel. The mounting adaptor may further include a fastener secured thereto, the fastener fastening the alcove structure to the mounting adaptor. The fastener may be secured to the back wall of the mounting adaptor and to the back wall of the alcove structure. The fastener may be double sided tape.

The back wall of the alcove structure may include a fastener adapted to removably retain the ornament in the alcove structure. The alcove structure fastener may be at least one keyhole adapted to receive therein a stud with a head on the free end thereof, secured to the ornament.

These and other features and advantages of the present invention will become more readily apparent during the following detailed description taken in conjunction with the drawings herein, in which:

BRIEF DESCRIPTION OF THE DRAWINGS OF THE INVENTION

DETAILED DESCRIPTION OF A PREFERRED EMBODIMENT OF THE INVENTION

Figure 1:
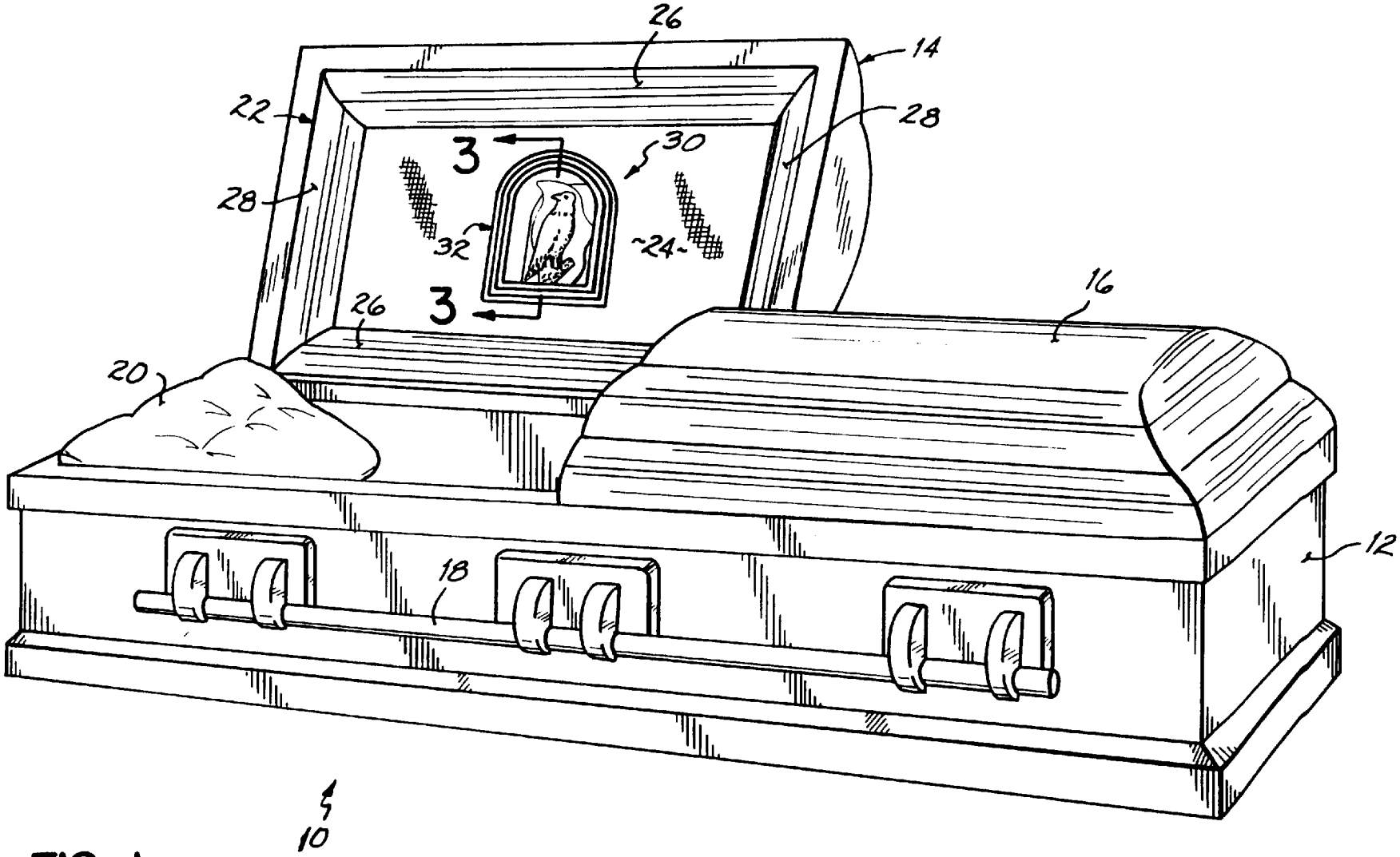
FIG. 1 is a perspective view of a casket including a head end cap dish with an alcove structure and an ornament displayed in the alcove structure, according to the principles of the present invention.

With reference to FIG. 1, there is illustrated a casket 10 according to the present invention. The casket 10 includes a lower body containing portion or shell 12, a head end cap 14 pivoted to a rear upper edge of the shell 12 and a foot end cap 16 likewise pivoted to the rear upper edge of the shell 12. Casket 10 may include handling apparatus 18 and interior trim 20 as is known in the art.

Referring now to all the Figures, the head end cap 14 may include a dish 22 mounted into an underside of head cap 14 in a manner known to those skilled in the art. Dish 22 may include a rectangular cap panel 24 having two pairs of opposing puffing members attached thereto, opposed side puffing members 26, 26 and opposed end puffing members 28, 28. An ornament display assembly 30 may be positioned preferably centrally of the panel 24.

Figure 2:
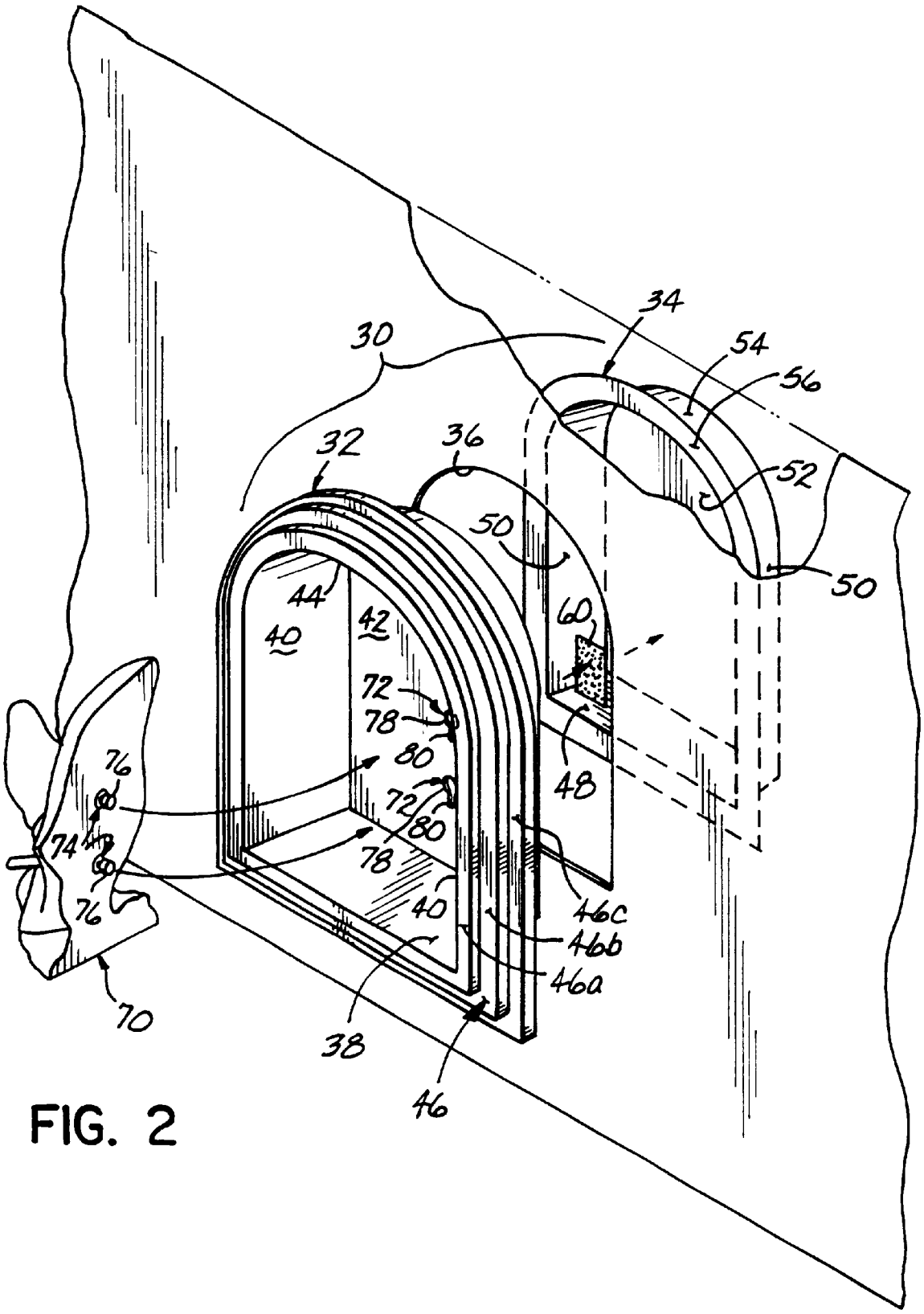
FIG. 2 is a disassembled perspective view, enlarged, of the dish and alcove structure of FIG. 1.
Figure 3:
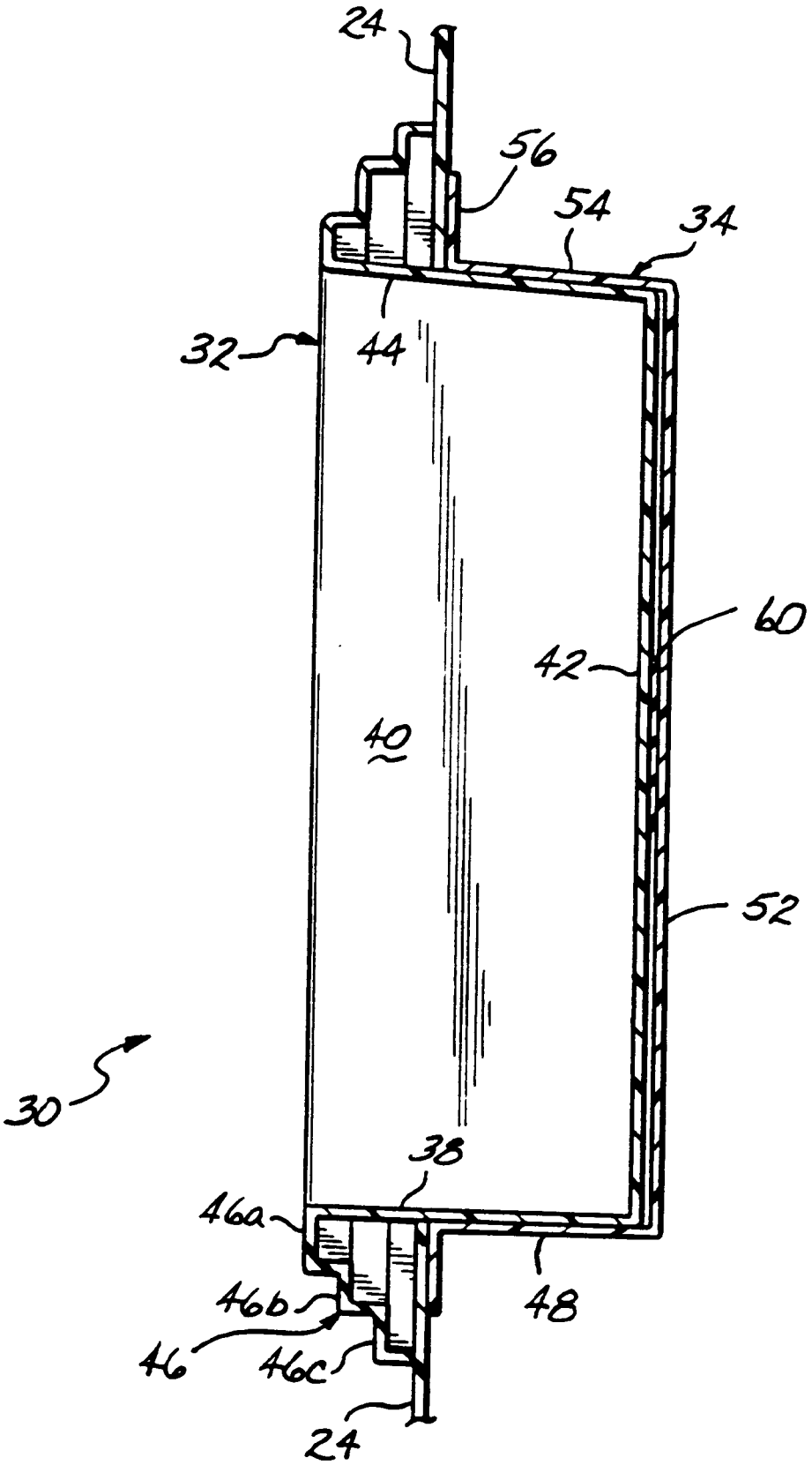
FIG. 3 is a view taken along line 3—3 of FIG. 1.

Referring now to FIGS. 2 and 3, the ornament display assembly 30 is shown in more detail. The display 30 may comprise, generally, an alcove structure 32 and a mounting adaptor 34 facilitating mounting of the alcove structure 32 to the panel 24. The panel 24 may include an opening 36 therein in which the alcove structure 32 is mounted. Alcove structure 32 may comprise a floor 38, a pair of opposed side walls 40, 40, a back wall 42 and a roof 44. The roof 44 of the alcove structure 32 may preferably be arcuately shaped for aesthetics. The alcove structure 32 may further comprise a flange 46 extending from the floor 38, side walls 40, 40 and roof 44. Flange 46 may be decorative and may have, as one example, steps 46*a*, 46*b* and 46*c*. Flange 46 faces panel 24 around a periphery of panel opening 36 and, as illustrated, abuts panel 24.

As first mentioned above, mounting adapter 34 facilitates mounting of alcove structure 32 to panel 24. Mounting adapter 34 may comprise a floor 48, a pair of opposed side walls 50, 50, a back wall 52 and a roof 54. The mounting adapter 34 may further comprise a flange 56 extending from the floor 48, side walls 50, 50 and roof 54. Mounting adapter 34 may preferably be of a size and geometry to permit alcove structure 32 to nestably fit within mounting adapter 34. To secure mounting adapter 34 to panel 24 flange 56 may be secured thereto with any suitable fastening means such as adhesive, staples, double-sided tape, by sewing, etc. As illustrated, flange 56 is secured to a back side of panel 24; however, it is to be appreciated that flange 56 could as well be secured to a front side of panel 24 if desired or required.

To removably secure alcove structure 32 to mounting adapter 34 a suitable fastening means such as double-sided tape 60 may be employed. Double-sided tape 60 may be adhered to the front side of back wall 52 of mounting adapter 34 and to the back side of back wall 42 of alcove structure 32 to removably secure the same together.

FIG. 2 illustrates an ornament 70 for removable securement to alcove structure 32. To removably secure ornament 70 to alcove structure 32 a suitable fastening means may be employed, such as the illustrated pair of key holes 72. 72 in rear wall 42 of alcove structure 24 in conjunction with a pair of studs 74, 74 secured to a rear side of ornament 70, which studs 74, 74 include heads 76, 76 on free ends thereof. Thus, to removably install ornament 70 in alcove structure 24 heads 76 of studs 74 are pushed through circular portions 78 of key holes 72 and then pushed downwardly such that heads 76 are retained by narrow slot portions 80 of key holes 72. In the event that double-sided tape 60 is of the foamed variety, the space between walls 52 and 42 should be sufficient so as to accommodate heads 76 of studs 74. If using a thin piece of double-sided tape, or a bead of adhesive, keyhole slots 72 may be required in both the walls 52 and 42. Further details of a similar mounting technique utilized to mount an ornament to a casket corner may be seen with reference to the assignee's prior-mentioned U.S. patent application Ser. No. 09/660,574.

It is contemplated that ornament 70 may be generally of the three-dimensional sculpture type or the like. It is further contemplated that a funeral director would have a number of different designs of ornaments 70 on hand from which a customer might choose. If desired ornament 70 could be identical to the ornaments mounted to the corners of the casket. An example of a casket corner ornament may be seen with reference to the assignee's U.S. Design. Pat. No. Des. 418,961 titled Casket Ornament, hereby incorporated by reference herein.

Those skilled in the art will readily recognize numerous adaptations and modifications which can be made to the present invention which will result in an improved memorialization casket, yet all of which will fall within the spirit and scope of the present invention as defined in the following claims. For example, while not illustrated in the drawings, the dish 22 could include a decorative cap panel insert which is installed in the dish 22 and held there by a friction hit within puffing members 26, 26 and 28, 28. In that case the cap panel insert would need to include an opening therethrough through which the alcove structure 32 could be viewed and/or installed. Accordingly, the invention is to be limited only by the scope of the following claims and their equivalents.

What is claimed is:

1. A casket comprising:

a shell;

a lid closeable upon said shell; and an alcove structure mounted to an underside of said lid, said alcove structure including a recessed area defined by a floor, a pair of side walls, a back wall and a roof and defining a front opening and a fastener therein adapted to receive and removably secure an ornament for display.

2. The casket of claim 1 wherein said casket lid includes a dish mounted to the underside of said casket lid, said alcove structure being mounted to said dish.

3. A casket comprising:

a shell;

a lid closeable upon said shell; and an alcove structure mounted to an underside of said lid, said alcove structure including a recessed area and a fastener therein adapted to receive and removably secure an ornament for display;

said casket lid includes a dish mounted to the underside of said casket lid, said alcove structure being mounted to said dish;

wherein said dish comprises a rectangular panel and a puffing member secured to each side of said rectangular panel.

4. The casket of claim 3 wherein said panel of said dish includes an opening therethrough and said alcove structure is mounted in said opening of said dish panel.

5. The casket of claim 4 wherein said alcove structure comprises:

a floor;

a pair of side walls;

a back wall; and a roof.

6. The casket of claim 5 wherein said alcove structure roof is arcuately shaped.

7. The casket of claim 4 further comprising:

an alcove structure mounting adapter mounted in said dish panel opening;

said alcove structure mounted to said adapter.

8. A casket comprising:

a shell;

a lid closeable upon said shell; and an alcove structure mounted to an underside of said lid, said alcove structure including a recessed area therein adapted to receive an ornament for display;

wherein said casket lid includes a dish mounted to the underside of said casket lid, said alcove structure being mounted to said dish;

wherein said dish comprises a rectangular panel and a puffing member secured to each side of said rectangular panel;

wherein said panel of said dish includes an opening therethrough and said alcove structure is mounted in said opening of said dish panel;

wherein said alcove structure comprises:

a floor;

a pair of side walls;

a back wall; and a roof;

wherein said alcove structure roof is arcuately shaped;

wherein said alcove structure includes a decorative flange extending from said floor, side walls and roof, said flange facing a portion of said dish panel around said dish panel opening.

9. A casket comprising:

a shell;

a lid closeable upon said shell; and an alcove structure including a flange around a periphery thereof and mounted to an underside of said lid, said alcove structure including a recessed area therein adapted to receive an ornament for display;

wherein said casket lid includes a dish mounted to the underside of said casket lid, said alcove structure being mounted to said dish;

wherein said dish comprises a rectangular panel and a puffing member secured to each side of said rectangular panel;

wherein said panel of said dish includes an opening therethrough and said alcove structure is mounted in said opening of said dish panel;

an alcove structure mounting adapter mounted in said dish panel opening;

said alcove structure mounted to said adapter;

wherein said alcove structure mounting adapter comprises:

a back wall; and a flange;

said flange being secured to said dish panel.

10. The casket of claim 9 wherein said mounting adapter further includes a fastener secured thereto, said fastener fastening said alcove structure to said mounting adapter.

11. The casket of claim 10 wherein said fastener is secured to said back wall of said mounting adapter and to said back wall of said alcove structure.

12. The casket of claim 11 wherein said fastener is double sided tape.

13. A casket comprising:

a shell;

a lid closeable upon said shell; and an alcove structure mounted to an underside of said lid, said alcove structure including a recessed area therein adapted to receive an ornament for display;

wherein said casket lid includes a dish mounted to the underside of said casket lid, said alcove structure being mounted to said dish;

wherein said dish comprises a rectangular panel and a puffing member secured to each side of said rectangular panel;

wherein said panel of said dish includes an opening therethrough and said alcove structure is mounted in said opening of said dish panel;

wherein said alcove structure comprises:

a floor;

a pair of side walls;

a back wall; and a roof;

wherein said back wall of said alcove structure includes a fastener adapted to removably retain the ornament in said alcove structure.

14. The casket of claim 13 wherein said alcove structure fastener is at least one key hole adapted to receive therein a stud with a head on a free end thereof, said stud secured to the ornament.

15. A dish adapted to be secured to an underside of a lid of a casket said dish comprising:

a rectangular panel and a puffing member secured to each side of said panel, said panel including an opening therethrough; and an alcove structure mounted in said dish panel opening, said alcove structure including a fastener adapted to receive and removably secure an ornament for display.

16. The dish of claim 15 wherein said alcove structure comprises:

a floor;

a pair of side walls;

a back wall; and a roof.

17. The dish of claim 16 wherein said alcove structure roof is arcuately shaped.

18. A dish adapted to be secured to an underside of a lid of a casket said dish comprising:

a rectangular panel and a puffing member secured to each side of said panel, said panel including an opening therethrough; and an alcove structure mounted in said dish panel opening[, said alcove structure including a flange around a periphery thereof];

wherein said alcove structure comprises:

a floor;

a pair of side walls;

a back wall; and a roof;

wherein said alcove structure roof is arcuately shaped;

wherein said alcove structure includes a decorative flange extending from said floor, side walls and roof, said flange facing a portion of said dish panel around said dish panel opening.

19. The dish of claim 18 further comprising:

an alcove structure mounting adapter mounted in said dish panel opening;

said alcove structure mounted to said adapter.

20. The dish of claim 19 wherein said alcove structure mounting adapter comprises;

a back wall; and a flange;

said flange being secured to said dish panel.

21. The dish of claim 20 wherein said mounting adapter further includes a fastener secured thereto, said fastener fastening said alcove structure to said mounting adapter.

22. The dish of claim 21 wherein said fastener is secured to said back wall of said mounting adapter and to said back wail of said alcove structure.

23. The dish of claim 22 wherein said fastener is double sided tape.

24. A dish adapted to be secured to an underside of a lid of a casket, said dish comprising:

a rectangular panel and a puffing member secured to each side of said panel, said panel including an opening therethrough; and an alcove structure mounted in said dish panel opening;

wherein said alcove structure comprises:

a floor;

a pair of side walls;

a back wall; and a roof;

wherein said back wall of said alcove structure includes a fastener adapted to removably retain an ornament in said alcove structure.

25. The dish of claim 24 wherein said alcove structure fastener is at least one key hole adapted to receive therein a stud with a head on a free end thereof said stud secured to the ornament.

26. A casket comprising:

a shell;

a lid closeable upon said shell;

an alcove structure mounted to an underside of said lid, said alcove structure including a recessed area therein adapted to receive an ornament for display:

said casket lid includes a dish mounted to the underside of said casket lid, said dish comprises a rectangular panel with an opening therethrough and a puffing member secured to each side of said rectangular panel;

said alcove structure comprises a floor, a pair of side walls, a back wall, a roof and a flange extending from said floor, side wails and roof, said flange facing a portion of said dish panel around said dish panel opening.

27. A casket comprising:

a shell;

a lid closeable upon said shell;

an alcove structure mounted to an underside of said lid, said alcove structure including a recessed area therein adapted to receive an ornament for display;

said casket lid includes a dish mounted to the underside of said casket lid, said alcove structure being mounted to said dish;

said dish comprises a rectangular panel with an opening therethrough and a puffing member secured to each side of said rectangular panel;

an alcove structure mounting adapter mounted to said dish panel, said alcove structure mounted in said panel opening and to said adapter, said alcove structure mounting adapter comprises a back wall and a flange, said flange abutting said dish panel.

28. A casket comprising:

a shell;

a lid closeable upon said shell;

an alcove structure mounted to an underside of said lid, said alcove structure including a recessed area therein adapted to receive an ornament for display;

said casket lid includes a dish mounted to the underside of said casket lid, said alcove structure being mounted to said dish;

said dish comprises a rectangular panel and a puffing member secured to each side of said rectangular panel;

said alcove structure comprises a floor, a pair of side walls, a back wall, and a roof;

said back wall of said alcove structure includes a fastener adapted to removably retain the ornament in said alcove structure.

29. A dish adapted to be secured to an underside of a lid of a casket said dish comprising:

a rectangular panel and a puffing member secured to each side of said panel, said panel including an opening therethrough;

an alcove structure mounted in said dish panel opening;

said alcove structure comprises a floor, a pair of side walls, a back wall, a roof and a flange extending from said floor, side walls and roof, said flange facing a portion of said dish panel around said dish panel opening.

30. A casket comprising:

a shell;

a lid closeable upon said shell;

a dish assembly mounted to an underside of said lid;

an alcove structure mounted to said dish assembly, said alcove structure having a floor, a pair of side walls, a back wall and a roof defining a front opening; and an ornament mounted in said alcove structure for display;

said alcove structure including a fastener removably retaining said ornament therein.

31. A casket comprising:

a shell;

a lid closeable upon said shell, said lid including a dish mounted to an underside of said lid;

an alcove structure mounting adapter positioned on a back side of said dish; and an alcove structure positioned on a front side of said dish and secured to said alcove structure mounting adapter, said alcove structure having a floor, a pair of side walls, a back wall and a roof defining a front opening.

32. The casket of claim 31 wherein each of said alcove structure and alcove structure mounting adapter includes a flange positioned against a respective one of said front and back sides of said dish.

33. A casket comprising:

a shell;

a lid closeable upon said shell, said lid including a dish mounted to an underside of said lid;

an alcove structure mounting adapter positioned on a back side of said dish; and an alcove structure positioned on a front side of said dish and secured to said alcove structure mounting adapter;

wherein said alcove structure includes a fastener adapted to removably retain an ornament therein.

34. A casket comprising:

a shell;

a lid closeable upon said shell, said lid including a dish mounted to an underside of said lid;

an alcove structure mounting adapter positioned on a back side of said dish; and an alcove structure positioned on a front side of said dish and secured to said alcove structure mounting adapter;

further including an ornament positioned in said alcove structure and removably retained there with a fastener.

35. A casket comprising:

a shell;

a lid closeable upon said shell, said lid including a dish mounted to an underside of said lid;

an alcove structure mounting adapter positioned on a back side of said dish; and an alcove structure positioned on a front side of said dish and secured to said alcove structure mounting adapter;

wherein each of said alcove structure and alcove structure mounting adapter includes a flange positioned against a respective one of said front and back sides of said dish;

wherein said dish includes an opening therethrough and wherein said alcove structure is positioned in said opening and in said alcove structure mounting adapter.

36. The casket of claim 35 wherein said alcove structure is secured to said alcohol structure mounting adapter via double sided tape.

37. The casket of claim 36 further including an ornament positioned in said alcove structure and removably secured therewith via a stud with a head thereon cooperating with a keyhole slot.

38. A casket comprising:

a shell;

a lid closeable upon said shell; and a dish assembly secured to an underside of said lid, said dish assembly comprising:

a rectangular panel having opposed side edges and opposed end edges;

a puffing member positioned at each said edge of said panel; and an alcove structure positioned between said panel side edges and between said panel end edges, said alcove structure adapted to receive and support an ornament for display;

wherein said alcove structure has a floor, a pair of side walls, a back wall and a roof defining a front opening.

39. A casket comprising:

a shell;

a lid closeable upon said shell; and a dish assembly secured to an underside of said lid, said dish assembly comprising:

a rectangular panel having opposed side edges and opposed end edges;

a puffing member positioned at each said edge of said panel; and an alcove structure positioned between said panel side edges and between said panel end edges, said alcove structure adapted to receive and support an ornament for display;

wherein said alcove structure includes a fastener for removably securing the ornament therein.

40. A casket comprising:

a shell having a front edge and a rear edge;

a lid hinged to said rear edge of said shell and closeable thereon; and a dish assembly secured to an underside of said lid, said dish assembly comprising:

a rectangular panel having four peripheral puffing members therearound and an alcove structure within the periphery thereof, said alcove structure having an opening which faces said front edge of said shell when said lid is open, said alcove structure adapted to receive and support an ornament for display;

wherein said alcove structure has a floor, a pair of side walls, a back wall and a roof defining said opening.

41. A casket comprising:

a shell having a front edge and a rear edge;

a lid hinged to said rear edge of said shell and closeable thereon; and a dish assembly secured to an underside of said lid, said dish assembly comprising:

a rectangular panel having four peripheral puffing members therearound and an alcove structure within the periphery thereof, said alcove structure having an opening which faces said front edge of said shell when said lid is open, said alcove structure adapted to receive and support an ornament for display;

wherein said alcove structure includes a fastener for removably securing the ornament therein.

42. A dish assembly adapted to be secured to an underside of a lid of a casket, said dish assembly comprising:

a rectangular panel having opposed side edges and opposed end edges;

a puffing member positioned at each said side edge of said panel; and an alcove structure positioned between said panel side edges and between said panel end edges, said alcove structure adapted to receive and support an ornament for display;

wherein said alcove structure has a floor, a pair of side walls, a back wall and a roof defining a front opening.

43. A dish assembly adapted to be secured to an underside of a lid of a casket, said dish assembly comprising:

a rectangular panel having opposed side edges and opposed end edges;

a puffing member positioned at each said side edge of said panel; and an alcove structure positioned between said panel side edges and between said panel end edges, said alcove structure adapted to receive and support an ornament for display;

wherein said alcove structure includes a fastener for removably securing the ornament therein.

* * * * *

UNITED STATES PATENT AND TRADEMARK OFFICE

CERTIFICATE OF CORRECTION

PATENT NO. : 6,715,190 B2
APPLICATION NO. : 09/788769
DATED : April 6, 2004
INVENTOR(S) : Brian K. Groemminger, Walter Hullemeyer and Charles F. Winburn It is certified that error appears in the above-identified patent and that said Letters Patent is hereby corrected as shown below:

Column 2, line 9 “favorite saying of the deceased” should be --favorite saying of the deceased,--.
Column 2, line 12, “function While” should be --function while--.
Column 4, line 6, “key holes 72. 72” should be --key holes 72, 72--.
Column 6, line 44, “lid of a casket” should be --lid of a casket,--.
Column 6, line 61, “lid of a casket” should be -- lid of a casket,--.
Column 6, lines 66-67, “[,said alcove structure including a flange around a periphery thereof] should be deleted.
Column 7, line 16, “comprises;” should be --comprises:--.
Column 7, line 25, “wail” should be --wall--.
Column 7, line 44 “thereof” should be --thereof,--.
Column 7, line 59, “wails” should be --walls--.
Column 8, line 31, “casket” should be --casket,--.
Column 9, line 36, “alcohol” should be --alcove--.

Signed and Sealed this

Second Day of January, 2007

JON W. DUDAS
*Director of the United States Patent and Trademark Office*